US005451315A

United States Patent [19]

Miller

[11] Patent Number: 5,451,315

[45] Date of Patent: Sep. 19, 1995

[54] ORE PASS SHAFF WATER DRAINAGE MEANS

[76] Inventor: Barry J. Miller, 71 Corranga Drive, Chigwell, Tasmania, 7011, Australia

[21] Appl. No.: 396,337

[22] Filed: Feb. 28, 1995

Related U.S. Application Data

[63] Continuation of Ser. No. 39,124, Apr. 2, 1993, abandoned.

[51] Int. Cl.[6] ..... E21F 16/00

[52] U.S. Cl. ..... 210/170; 210/433.1; 209/273; 193/34; 299/8; 299/12; 405/39; 405/139

[58] Field of Search ..... 209/202, 203, 273; 210/154, 156, 159, 170, 433.1; 193/33, 34; 299/7, 8, 12; 405/36, 39, 118, 119, 138, 139

[56] References Cited

U.S. PATENT DOCUMENTS 280,069 6/1883 Nelson et al. ..... 209/203
441,089 11/1890 Brewster ..... 209/202
1,678,142 7/1928 Hopkins ..... 209/202
3,420,658 1/1969 Reding, Jr. et al. ..... 209/202

FOREIGN PATENT DOCUMENTS 985297 12/1982 U.S.S.R. .

OTHER PUBLICATIONS

SME Mining Engineering Handbook (1973), pp. 12-24-8—12-249.

Websters New World Dictionary Third College Edition; p. 5; 1988.

*Primary Examiner*—Robert A. Dawson
*Assistant Examiner*—Robert James Popovics
*Attorney, Agent, or Firm*—Edwin D. Schindler

[57] ABSTRACT

An ore pass rush eliminator is disclosed which includes, in the ore pass shaft, a channel formed in the base of the shaft whereby excess water can pass to waste to avoid any build up of such water. Further described are means whereby the channel may be kept clear of build up of ore by means of an endless chain.

10 Claims, 5 Drawing Sheets

ORE PASS SHAFF WATER DRAINAGE MEANS

This is a continuation of application Ser. No. 08/039,124, filed Apr. 2, 1993, now abandoned.

BACKGROUND OF THE INVENTION

This invention relates to a system to restrict ore rushes in ore pass shafts in underground mining.

Ore pass shafts are used where mining in ore bearing layers vertically spaced above a main drive shaft and comprising shafts through which the ore mined can be delivered to trucks or the like in the main drive shaft.

The ore pass shafts can be up to five meters in diameter and, on occasions, up to one thousand meters long.

The lower end of the ore pass shaft has a shute output with a gate thereon and, in practice, there may be a build up of ore of up to a depth of one hundred meters in the shaft.

As will be appreciated most mines have running water therein and it is not unusual for water to enter the pass shaft and as this water can effectively not escape from the shaft there can be substantial build up of water adjacent the base of the shaft.

This can lead to a situation that, when the gate is opened to permit ore to be delivered to a train, the ore and water can be uncontrollably released, partially because of the additional weight provided by the water but also because the ore is effectively lubricated by the water, and thus the ore leaves the gate much more rapidly than would otherwise be the case.

It is not unusual in such circumstances for the operators in the main drive shaft to be overwhelmed by the effluxion of ore and water and this can lead to fatalities amongst the operators.

SUMMARY OF THE INVENTION

The object of the invention is to provide a means to drain water from the ore so as to prevent any undesirable build up of water in the ore in the ore pass shaft.

The invention in its broadest aspect includes in association with an ore pass shaft a channel in connection with the shaft so located that water in the shaft can drain into the channel and be passed to waste, the channel being of such a length that it extends from adjacent the delivery end of the shaft to a distance at least equivalent to the expected build up of ore in the shaft.

The channel can be formed by separating a portion of the base of the shaft from the remainder of the shaft by means of plates located on the floor of the shaft or, alternatively, the channel could be provided by the formation of a bore hole or the like spaced from but parallel to the shaft and in connection with the shaft along its length to permit water to flow from the shaft into the channel comprised of the bore hole.

BRIEF DESCRIPTION OF THE DRAWING FIGURES

In order that the invention may be more readily understood reference will be made to the accompanying drawings in which.

DETAILED DESCRIPTION OF THE DRAWING FIGURES AND PREFERRED EMBODIMENTS

Figure 1:
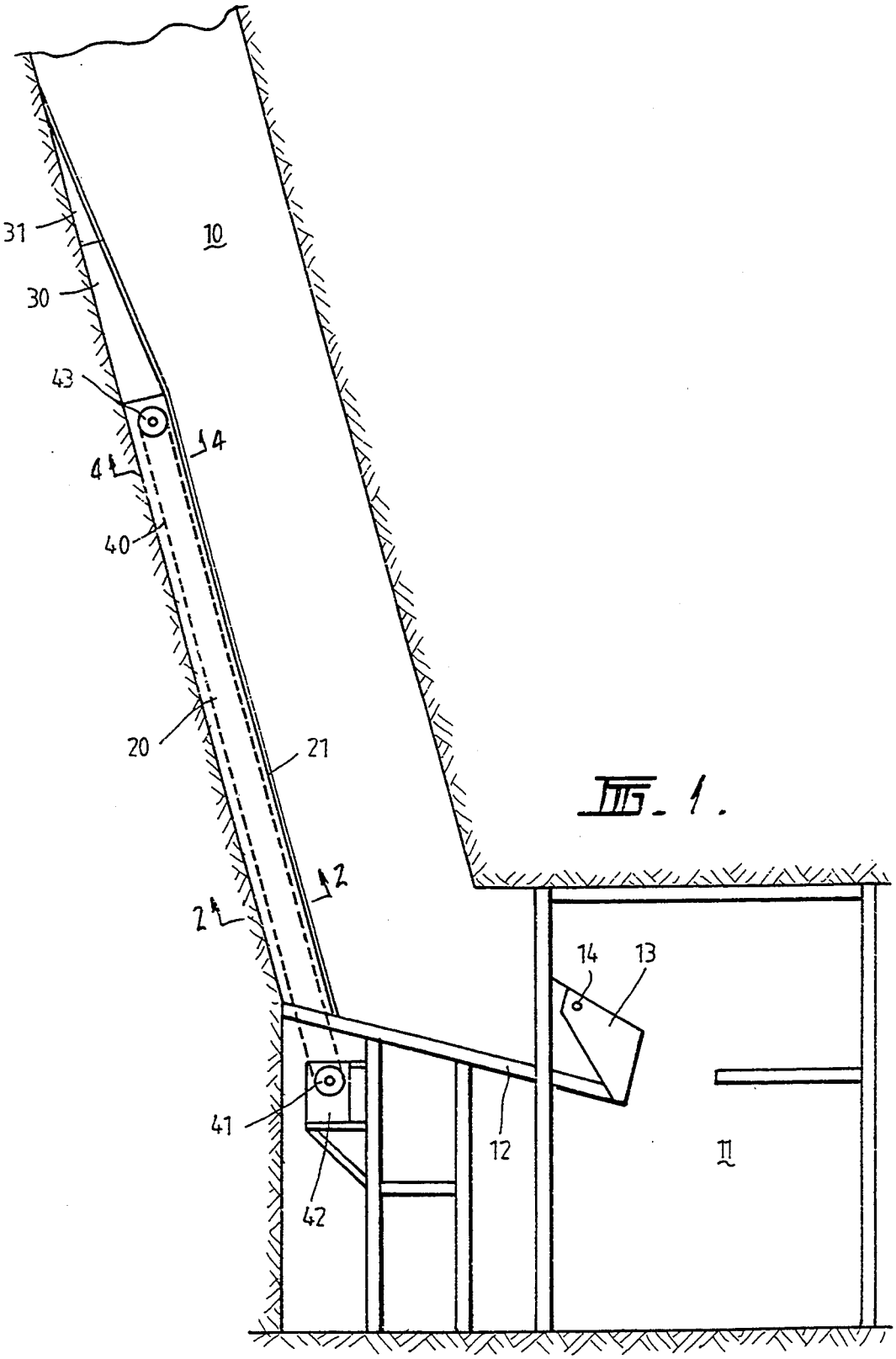
FIG. 1 is a side elevation of one particular arrangement of ore pass shaft and its associated channel made in accordance with the invention.

Referring to FIG. 1 there is an ore pass shaft 10 which runs from an upper level at which ore is being mined to the main drive shaft 11 in which a train or the like can run.

The pass shaft has at its lower end a shute plate 12 which defines an outlet which is closed by a gate 13.

This gate is pivotally mounted about a hinge 14 and can be rotated from a position at which it exposes the lower end of the pass shaft 10 to a closed position, as illustrated in FIG. 1, wherein the ore is retained in the pass shaft.

As previously mentioned the dimensions of the pass shaft 10 can vary but can be up to five meters in diameter and also the shape of the shaft can vary widely, it can be circular, square or rectangular or even oval.

At its upper end, not shown, the pass shaft may simply comprise an opening into which ore is passed or could have some form of closure for safety purposes.

In operation as the ore is mined it is passed into the pass shaft and the shaft can provide what is effectively a reservoir of ore for delivery to rail trucks or the like.

There can, for example, be up to one hundred meters of ore in the shaft at any time.

Figure 2:
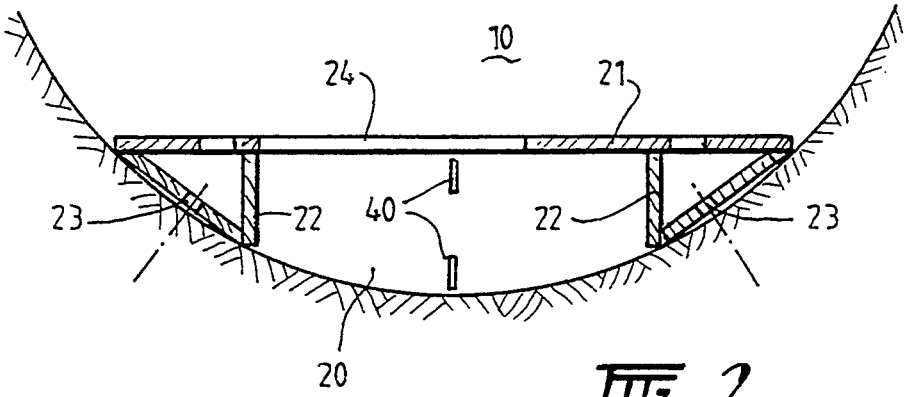
FIG. 2 is a section along line 2—2 of FIG. 1.

The pass shaft is provided with what is defined herein as a channel 20, see for example FIG. 2, which may be comprised of a plate or plates 21 which are located on supports 22 which can be held into the shaft wall by means of rock bolts, not illustrated at 23.

Figure 3:
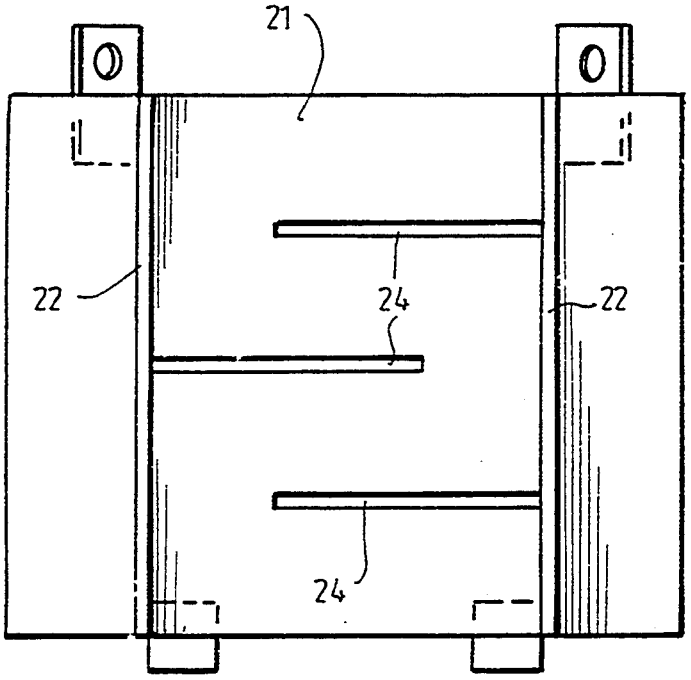
FIG. 3 is a view of a support plate.

The plates 21 can be provided with slots 24, as illustrated in FIG. 3 or, at least as far as the lower plate is concerned could be formed solid.

The purpose of the slots 24 is to permit the passage of water from the pass shaft into the channel from whence it can flow and be delivered to waste or a sump from which it could be pumped from the mine.

At the upper end of the plates 24 there can be a ramp like member or members 30 and 31 which simply provide a ramp along which the ore passes so that it is located on the plates 21.

Figure 4:
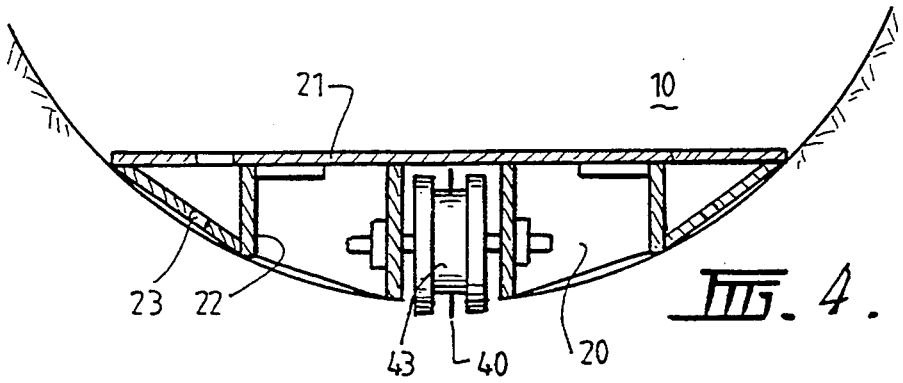
FIG. 4 is a section along line 4—4 of FIG. 3.

Located in the channel there is a continuous chain 40 which may be connected between a lower pulley 41 which is driven by an air motor or the like 42 and an upper pulley 43 which can also be seen in FIG. 4. This moving chain passes close to the plate 21 to dislodge any solid material passing into the channel through slots 24 and which material may act to obstruct the channel or slots and restrict the water flow.

Although not illustrated the chain 40 could be provided with paddles or the like to facilitate this movement.

In use it will be seen that as the ore passes down the ore pass shaft 10 it is cause to enter the lower portion of this shaft and is deflected by the ramps 30 and 31 so as to lie, in its lowest surface, against the plates 21.

Water carried by the ore or, more particularly, water which also flows into the pass shaft tends to fall under gravity towards the plates 21 and through the recesses 24. On entering the channel 20 the water simply flows theredown and passes either to waste or to some form of sump whereby it can be pumped to the surface or the like.

In order to prevent any build up in the channel the motor 42 causes the endless chain 40 to move any material which tends to fall into the recesses 24 and to ensure that this is positively removed from the channel.

It will be seen that the arrangement of the invention prevents any build up of water in the lower end of the pass shaft and even if small pockets of water should form on any movement of the ore these will tend to enter the channel and be delivered therefrom.

Thus when the gate 13 is opened to deliver ore to a wagon or the like there will be no build up of water in the pass shaft and the delivery of the ore will be orderly and as expected and as such the operators are effectively protected from any unexpected result.

Figure 5:
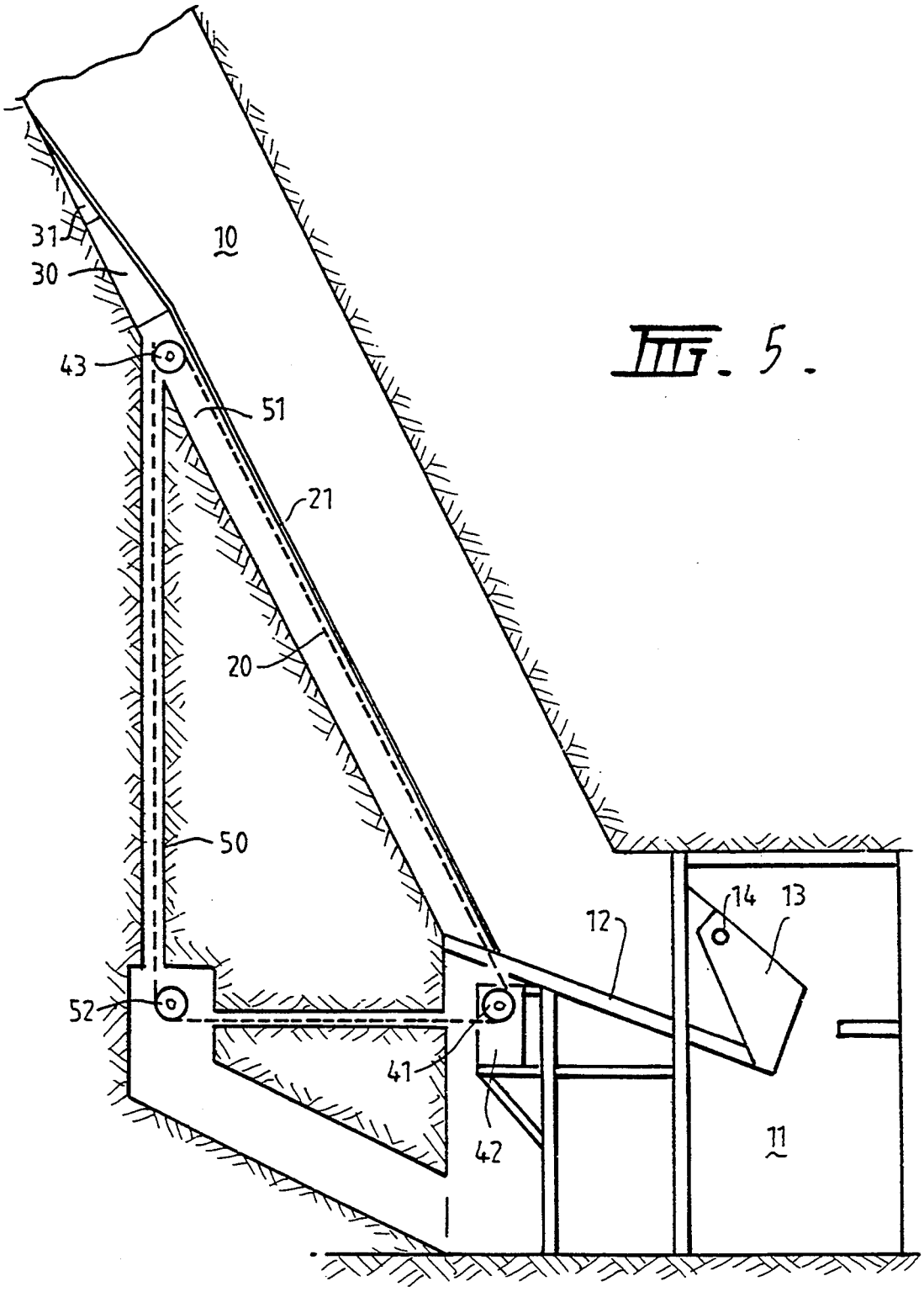
FIG. 5 is a view similar to FIG. 1 showing an alternative embodiment of the invention.

FIG. 5 illustrates an alternative embodiment of the invention which, it can be seen, is very similar in effect to that of the earlier embodiment.

In this case I provide a bore 50 which diverges from the main shaft 51 but is in connection therewith at the upper end of the channel.

There is an endless chain 20 in the channel which passes over pulleys 41, 43 in a manner similar to the first embodiment but in this embodiment one run of the chain passes through bore 50 and about an additional pulley 52.

In operation, this arrangement is the same as that of the earlier embodiment.

Figure 6:
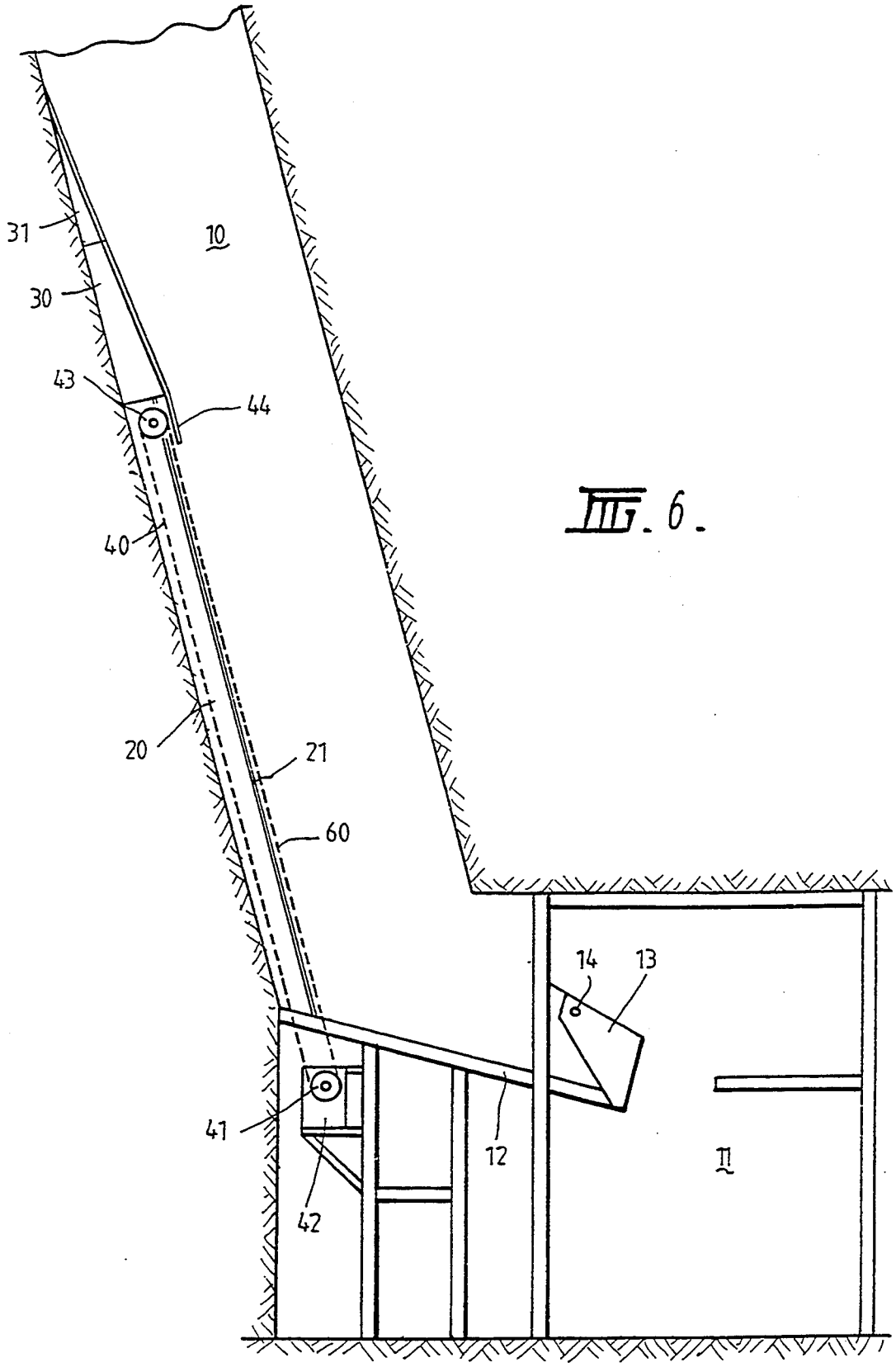
FIG. 6 is a view similar to that of FIGS. 1 & 5 showing a further modified form of the invention.

Referring now to the embodiment of FIG. 6, this provides an arrangement which is similar to that of FIG. 1 except that the chain 40 has a top run 60 which passes over the top of the plates 21 rather than therebeneath and so the pulley 43 is located slightly higher than is the case with the earlier embodiment.

The ramp-like members 30 and 31 can be slightly higher relative to the pulley 43 and may be provided with an extension 44 which overlies the pulley 43.

This modification can serve two purposes.

Generally, the chain 40 can act to clear any build-up of material in the channel 20 as discussed in respect of the first embodiment.

The outer run 60 of the chain can also help dislodge material which is barring the shute.

In practice it is found that there are occasions when, rather than having an ore rush, the ore actually bars the shute and in order the clear such bar it may be necessary for persons to enter the shute and possibly set an explosive charge in the ore to release the blockage.

This of course is in itself dangerous as the actual laying of the charge may in fact dislodge the ore, and the workmen are directly beneath the ore in the shute.

The operation of the chain between the plates and the ore can well assist in the dislodgement of the material and overcome this difficulty.

The shield 44 overlays the upper pulley 43 and protects it from the normal movement of ore down the shute.

Figure 7:
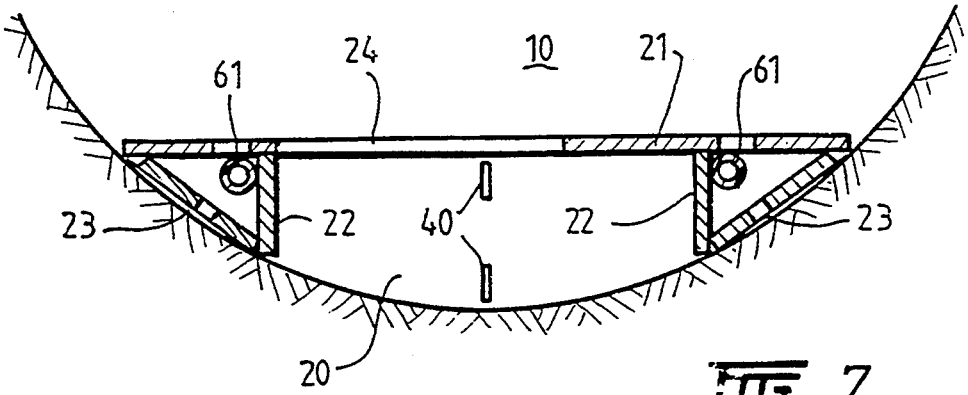
FIG. 7 is a view similar to that of FIG. 2 of a further modified form of the invention.
Figure 8:
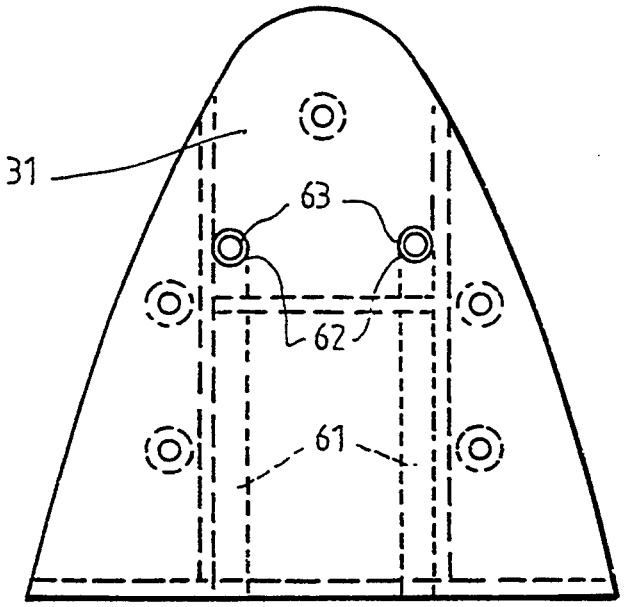
FIG. 8 is a view of the member 31 of the form of invention of FIG. 7.
Figure 9:
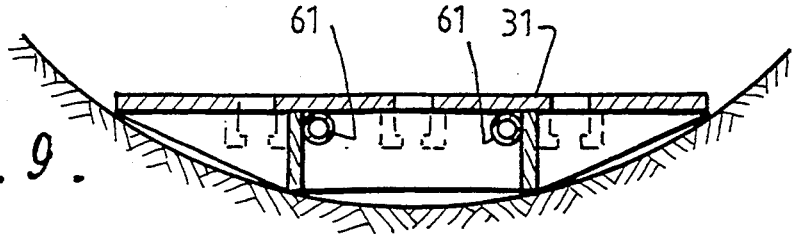
FIG. 9 is a cross-sectional view of the end of the member 31.

The embodiment of FIGS. 7 to 9 can also act to release barring in the shute.

FIG. 7 shows a plate 21 and this can be considered to be similar to FIG. 2 with the difference being that there are a pair of pipes 61 which may be a flexible pipe of a relatively pressure resistant material passing between the plate and the support 22.

FIGS. 8 and 9 show the upper ramp member 31 in elevation and plan respectively and as can be seen from FIG. 9 the pipes 61 extend upwardly beneath this upper ramp member and terminate at apertures 62 in the ramp 31.

This termination may be in the form of a nozzle 63 and the type of nozzle an vary.

The pipes 61 can carry pressure water and if there is a blockage in the ore pass shute water can be passed through the pipes 61 and through the nozzle 63 and this can often act to free the blockage by moving some of the ore in the shute so that the ore in the shute can fall therethrough.

Again this may remove the necessity of workers entering the shute to release the blockage and thus reduce the danger to such workers.

The provision of such a water supply can be provided in any of the earlier embodiments.

I claim:

1. In combination with an ore pass shaft, a channel defined by plates located in said shaft on a wall of the shaft, but spaced therefrom, the plates having apertures therethrough which water in the ore pass shaft can pass into the channel and be passed to waste, said channel extending a sufficient distance from adjacent a delivery end of the shaft to allow water drainage, said channel having therein, an endless chain located adjacent the plates wherein movement of the chain by a drive means dislodges any solid material entering the channel from the shaft, thereby preventing the build up of solid material in the channel.

2. A shaft as claimed in claim 1 wherein the plates have extensions thereon to locate the plates in spaced positions, which extensions are held to said wall of the channel.

3. A shaft as claimed in claim 1 wherein adjacent an inner end of the channel, there are ramp means deflecting the ore to cause it to pass onto the plates.

4. A shaft as claimed in claim 1 wherein there is a bore hole in connection with the channel adjacent an upper end thereof, the lower end of the bore hole in connection with the channel a run of-the endless chain (40) passing along the channel and another passing from the top to the bottom of the channel through the bore hole.

5. A shaft as claimed in claim 4 wherein the bore hole diverges from the channel adjacent the delivery end thereof.

6. A shaft as claimed in claim 1, wherein a run of said endless chain is located within the channel and another run of said endless chain is located above the plates defining the channel.

7. A shaft as claimed in claim 6 wherein an upper pulley of the endless chain is protected by a shield which passes thereabove.

8. A shaft as claimed in claim 1 wherein there is a means to provide water to the ramp which can be selectively actuated to supply water to the shaft to help free any build up of ore in the shaft.

9. A shaft as claimed in claim 8 wherein there are provided apertures in the ramp through which pass nozzles from which water can be delivered.

10. A shaft as claimed on claim 8 wherein there are pipes which pass within the channel from a lower end of the shaft to the ramp and supply water to the means.

* * * * *